US005205857A

United States Patent [19]

Yokoyama

[11] Patent Number: 5,205,857

[45] Date of Patent: Apr. 27, 1993

[54] METHOD AND APPARATUS FOR RECOVERING SUBSTANCE ADHERED TO OBJECT TO BE PROCESSED

[75] Inventor: Yoshiaki Yokoyama, Urawa, Japan

[73] Assignee: Ogihara Technical Center Co., Ltd., Ota, Japan

[21] Appl. No.: 813,975

[22] Filed: Dec. 26, 1991

[30] Foreign Application Priority Data

Dec. 27, 1990 [JP] Japan ..... 2-414963

[51] Int. Cl.[5] ..... C22B 7/00

[52] U.S. Cl. ..... 75/401

[58] Field of Search ..... 75/401

[56] References Cited

U.S. PATENT DOCUMENTS 3,762,911 10/1973 von der Crone ..... 75/401

*Primary Examiner*—Peter D. Rosenberg

*Attorney, Agent, or Firm*—Kenyon & Kenyon

[57] ABSTRACT

A method for recovering substance such as zincing or the like adhered to the surface of an object to be processed, by causing such materials to be evaporated in a vacuum. In this method, the object to the processed is placed in a furnace provided with heating means; the temperature within the furnace is elevated up to a predetermined level with the aid of an oxidizing gas atmosphere; the pressure in the furnace is reduced so that the quantity of the oxidizing gas is reduced to be below the explosion limit; and vaccum or a reducing gas atmosphere is fed into the furnace to reduce the oxidization of the object to be processed. Thereafter, the interior of the furnace is evacuated while being maintained under a predetermined evaporation temperature condition; and the substance evaporated from the object to be processed is passed to recovery means provided in communication with the furnace, so that the substance thus evaporated is condensed in the recovery means and recovered therefrom.

10 Claims, 5 Drawing Sheets

METHOD AND APPARATUS FOR RECOVERING SUBSTANCE ADHERED TO OBJECT TO BE PROCESSED

BACKGROUND OF THE INVENTION

1. Field of the Invention

This invention relates to a cleaning method and apparatus for removing liquid substance such as water, oil or the like and/or solid substance such as zincing or the like which is adhered to the surface of an object. It also concerns a method and an apparatus for efficiently recovering substance such as plated material adhered to the surface of an object to be processed, by causing such materials to be evaporated in a vacuum.

2. Description of the Prior Art

Such procedures as pickling, shot-working, and in-air oxidation removal have heretofore been well known in the art as methods of removing zincing provided on the surfaces of an automobile body, for example.

Of such conventional methods, pickling is most commonly employed, but it is disadvantageous in that the cleaning liquid used therewith tends to cause environmental pollution and also in that the running cost is high and skilled workers are needed. Shot-working also has such disadvantages that the running cost is high and difficulties are experienced in processing shot-particles having zinc adhered thereto. Further, the in-air oxidation removal procedure is disadvantageous in that oxide tends to be formed on the object to be processed per se and the dezincing ability is poor. Thus, in the case where iron plate is melted for recycling, unmelted material such as iron oxide, zinc oxide or the like and/or zinc is caused to infiltrate into the wall of the furnace so that the life span of the furnace tends to be shortened.

Also well known in the art is a method of recovering zinc, nickel and/or lead adhered to the surface of an automobile body and/or oil adhered thereto, by increasing the temperature of the vacuum atmosphere in which such a body is placed. However, due to the fact that no convection-heating means is provided, such conventional method is disadvantageous in that the temperature increasing rate in the range of 0° to 500° C. is extremely low; thus, when it is attempted to effect dezincing of 6,000 tons of scrap per month, a large-sized equipment is inevitably required so that the cost merit is lost because of its high initial cost. To cope with such problems, it may be conceivable that oxidation-heating is effected during the low-temperature period while vacuum-heating is carried out during the evaporation period. With such a procedure, however, metal oxide is formed so that the vacuum-evaporation temperature should be elevated as a matter of course; thus, to completely remove the zincing, the temperature should be elevated for a long period of time. In this case, too, the cost merit is lost as in the above-mentioned cases.

As mentioned above, the prior-art method is disadvantageous in that the temperature rising rate of the conventional vacuum furnace is low; heating with inert gas such as nitrogen gas or the like is high in running cost; oxidation-heating requires that the evaporation temperature be elevated so that the evaporation rate turns out to be slow, which has adverse effect on the running cost or the like.

SUMMARY OF THE INVENTION

Accordingly, it is an object of the present invention to obviate the above-mentioned drawbacks of the prior art.

Another object of the present invention is to provide a method of cleaning the surface of a solid object to be processed and a method of recovering an evaporated substance, which comprise the steps of placing the object to be processed in a closed atmosphere, and heating and evacuating the closed atmosphere after reducing the pressure in the closed atmosphere, or reducing the pressure in the closed atmosphere after increasing the pressure in the closed space to a pressure before the pressure reduction with a convective and temperature and heating the closed atmosphere, thereby removing liquid substance and/or solid substance adhered to the object to be processed, through variations in the temperature and pressure in the closed atmosphere.

Still another object of the present invention is to provide an apparatus for cleaning the surface of a solid object to be processed and an apparatus for recovering an evaporated substance, which comprise a closed container having a closed atmosphere in which the object to be processed is placed; heating means for elevating the temperature within the closed container; condensing means in communication with the closed container for condensing metal or non-metal removed from the object to be processed; pressure reducing means for reducing the pressure in the closed container through the condensing means; pressure increasing means for increasing the pressure in the closed container with a non-oxidizing gas; and pre-heating means for utilizing the gas for the purpose of pre-heating the object to be processed.

A further object of the present invention is to provide a method for efficiently recovering substance such as zincing or the like adhered to the surface of an object to be processed, by causing such substance to be evaporated in a vacuum, which comprises placing the object to the processed in a furnace provided with heating means; elevating the temperature within the furnace up to a predetermined level in a vacuum condition or with the aid of an oxidizing gas atmosphere; reducing the pressure in the furnace so that the quantity of the oxidizing gas is reduced to be below the explosion limit; feeding a reducing gas atmosphere into the furnace or creating a vacuum condition to reduce the oxidization of the object to be processed; thereafter evacuating the interior of the furnace while the interior of the furnace is maintained under a predetermined evaporation temperature condition; and introducing the substance evaporated from the object processed to recovery means provided in communication with the furnace, so that the evaporated substance is condensed in the recovery means and recovered therefrom.

A still further object of the present invention is to provide an apparatus for efficiently recovering substance such as zincing or the like adhered to the surface of an object to be processed, by causing such substance to be evaporated in a vacuum, which comprises heating means for elevating the temperature within a furnace; condensing means for causing gas and/or liquid to be condensed; pressure reducing means for reducing the pressure within the furnace through the condensing means; and pressure increasing means for increasing the pressure within the furnace by flowing a reducing gas into the furnace.

Other objects, features and advantages of the present invention will become apparent from the ensuing description taken in conjunction with the accompanying drawings.

DESCRIPTION OF THE PREFERRED EMBODIMENTS

Description will now be made of a first embodiment of the present invention, and in accordance with this embodiment, there is provided a method in which in an attempt to remove metal or non-metal adhered to an object to be processed, the object is placed in a hermetically closed container; the interior of the hermetically closed container is heated by heating means and evacuated after the pressure therein is reduced by pressure reducing means, or alternatively a non-oxidizing gas is fed into the hermetically closed container by pressure increasing means for increasing pressure prior to pressure reduction and the interior of the container is heated under the heat transfer action of the non-oxidizing gas, and subsequently the container is evacuated and the interior of the container is heated up to a temperature equal to or higher than the boiling point of the metal or non-metal adhered to the object to be processed, so that the metal or non-metal is evaporated; and thereafter, the pressure in the container is reduced while the interior of the container is kept under the heated condition, and the vapor of the metal or non-metal is recovered and passed to be condensed in condensing means provided in a recovery line and finally the evaporated substance is recovered.

As the non-oxidizing gas, use is made of inert gas such as nitrogen, argon air or the like, and care is taken to enhance the temperature increasing speed and cooling speed of the recovered substance when the interior of the hermetically closed container is pressurized and heated. The non-oxidizing gas may also be passed to a pre-heating chamber and utilized to pre-heat the object to be processed. It is reasonable to consider that the substance such as metal or non-metal may be a composite one consisting of several materials instead of a single substance such as metal or non-metal; thus, preferably, the vapor pressure at the predetermined temperature at which the object to be processed is heated, should be set up to be variable over a predetermined range, and under such a condition, selection should be made with respect to the extent of pressure reduction (degree of the vacuum) within the hermetically closed container, heating temperature, the extent to which the inert gas is pressurized, and so forth.

Figure 1:
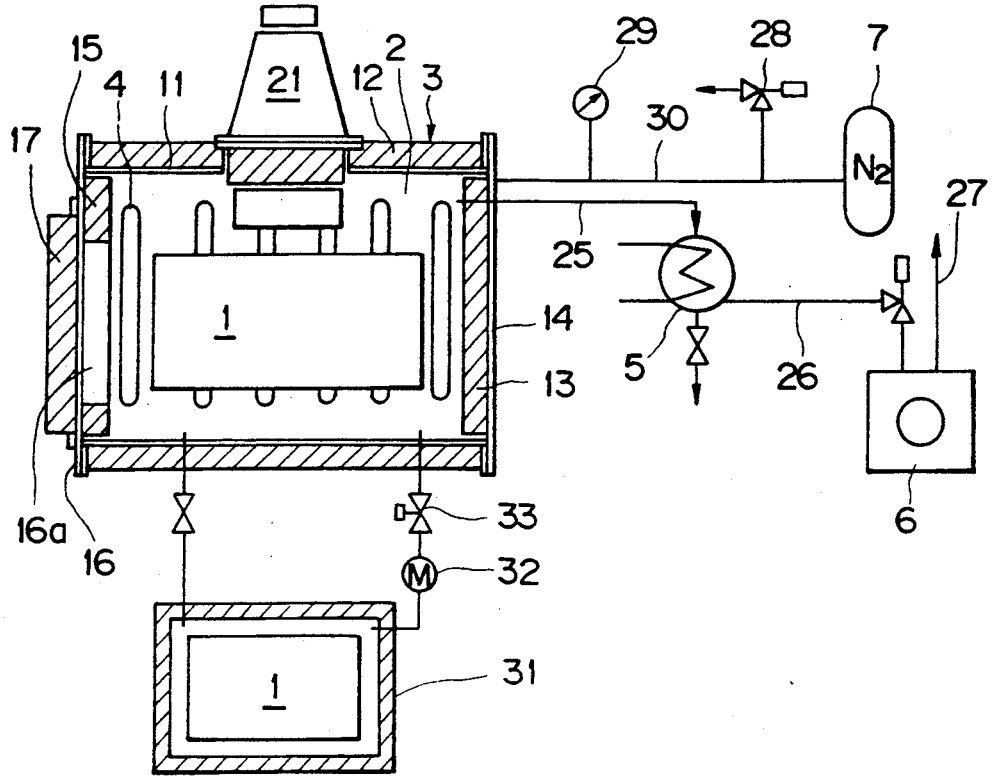
FIG. 1 is a schematic view, partially in cross-section, showing the cleaning system according to an embodiment of the present invention.
Figure 2:
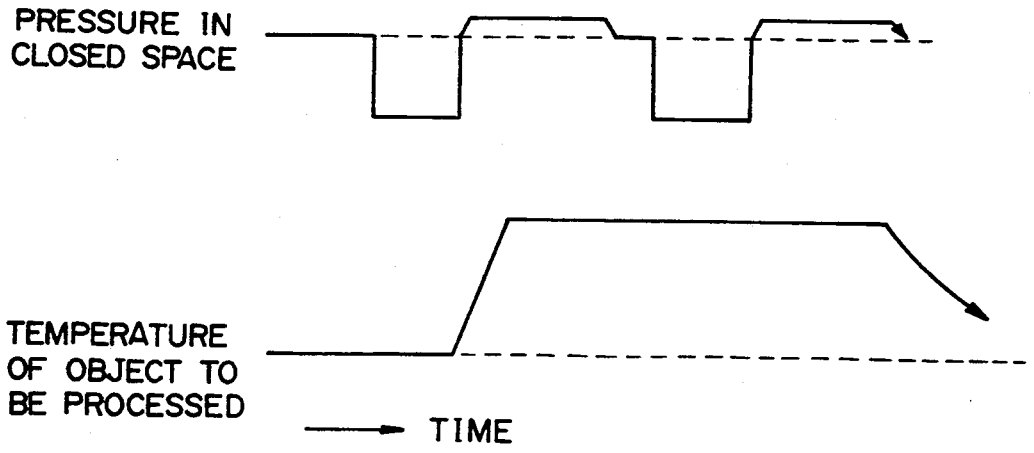
FIG. 2 is a graph illustrating variations with time in the pressure in the closed atmosphere and the temperature of the object to be processed.
Figure 3:
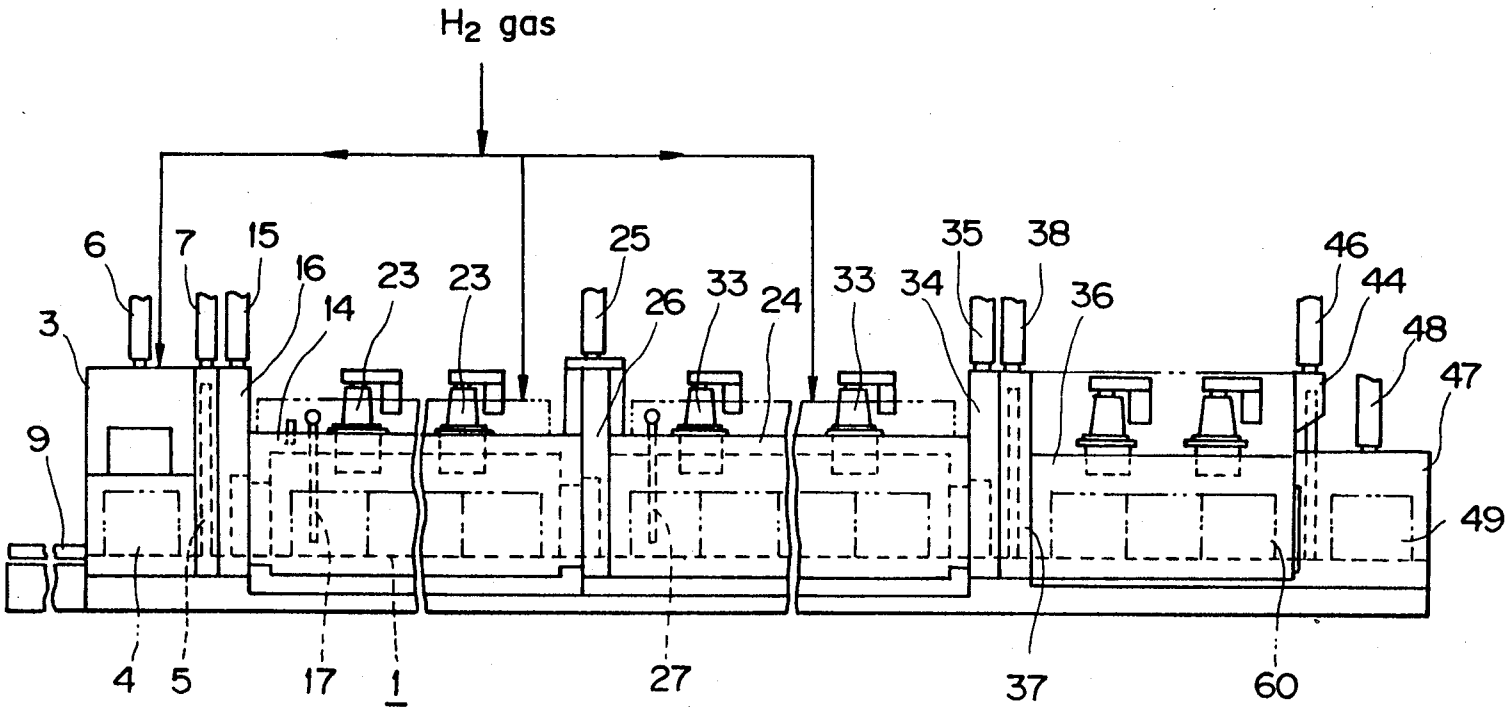
FIG. 3 is a front view showing a second embodiment of the present invention.

Referring to FIGS. 1 and 2 of the drawings, the apparatus for carrying out the above-mentioned method according to the first embodiment of the present invention will be described, which comprises a hermetically closed container 3 having a hermetically closed space or atmosphere 2 in which an object 1 to be processed is placed; a heater 4 acting as heating means for elevating the temperature of the substance adhered to the surface of the object to be processed; a condenser 5 serving as means for causing the evaporated substance or the like removed from the object 1 to be condensed; a pressure reducing pump 6 serving as means for reducing the pressure in the hermetically closed container 3 through the condenser 5; a gas cylinder 7 serving as means for increasing the pressure in the hermetically closed container 3 with the aid of non-oxidizing gas; and a pre-heating furnace 31 in which is introduced nitrogen gas for cooling the heated object 1 to use the nitrogen gas to pre-heat the object to be processed.

More particularly, the hermetically closed container 3 comprises a container body consisting of a hollow 11 and a heat insulating material 12 provided on the outer surface of the retort 11; a rear heat insulating door 14 lined with a heat insulating material 13 and mounted at one side of the container body; a front heat insulating door 15 lined with a heat insulating material 15 and mounted at the other side of the container body; a front door 17 mounted to open and close an opening portion 16*a* of the front heat insulating door 6, whereby a hermetically closed space or atmosphere 2 is defined within the container 3. An agitator 21 is provided at the top of the hermetically closed container 3, and a heating element 4 is provided in the space 2 to elevate the temperature of the atmosphere 2. Further, the condenser 5 is connected in the communication with the hermetically closed space 2 through piping 25 and also with the pressure reducing pump 6 through piping 26. The pressure reducing pump 6 is provided with an exhaust pipe 27. The nitrogen gas cylinder 7 is connected to the hermetically closed container 3 via piping 30 including a pressure regulator valve 28 and a pressure gauge 29.

In operation, the front door 17 is opened, and the object 1 to be processed is loaded into the hermetically closed container 3. Subsequently, the front door 17 is lowered to close the opening portion 16*a*; the pressure reducing (vacuum) pump 6 is operated, thereby reducing the pressure in the space 2 of the closed container 3 down to about $10^{-2}$ to $10^{-4}$ Torr. Then, nitrogen gas is supplied to increase the pressure in the space 2 through the piping 30, and the agitator 21 is operated. The atmosphere 2 is heated up to a predetermined temperature by means of the heating element 4 while being agitated by the agitator 21. As a result, the temperature of the object 1 to be processed is elevated under the heat transfer action of the nitrogen gas. At a time point when a predetermined temperature (temperature at which evaporation does not occur too much) is reached, the pressure in the atmosphere 2 is reduced, and the object 1 to be processed is further heated so that the substance adhered to the surface thereof is evaporated. The pressure in the atmosphere is then caused to build up as a result of the atmosphere being supplied with nitrogen gas, and the atmosphere is cooled; the nitrogen gas, which is heated to some extent, is introduced into the pre-heating furnace 31 to pre-heat the object 1 to be processed. FIG. 2 illustrates variations with time in the pressure in the closed atmosphere 2 and the temperature of the object 1 to be processed. The evaporated substance is accommodated and condensed in the condenser 5 and then recovered. The object 1, when cooled, is taken out, with the front door 17 open.

As will be appreciated from the above discussion, according to this embodiment of the present invention, metal ar non-metal adhered to the surface of an object to be processed can be most efficiently removed without using any special cleaning agent, combustion flame or the like as in the prior art. Advantageously, the cleaning process is effected within a hermetically sealed processing atmosphere so that there occurs no possibility of environmental pollution; the substance adhered to the object to be processed is evaporated in a vacuum and thus recovered in a substantially pure form and can be recycled; the solid or liquid substance adhered to the object to be processed, whether it is metal or non-metal, can be recovered with an extremely high efficiency so that the running cost can be reduced and automation can readily be achieved.

Referring to FIGS. 3 to 6, there are illustrated other embodiments of the present invention which may incorporate the principles of the embodiment shown in FIGS. 1 and 2 and described above.

According to the present invention, in this aspect, there is provided a method for removing and recovering liquid and/or solid substance such as water, metal plating or the like adhered to an object to be processed, wherein an object to be processed is previously heated up to a desired temperature in a vacuum condition or an oxidizing atmosphere furnace; the object to be processed is then successively loaded into closed containers which are arranged in contiguous relationship with and in communication with each other; the pressure in each of the individual closed containers is reduced by pressure reducing means; and thereafter, the interior of each closed container is heated by heating means and evacuated, or alternatively reducing gas is supplied by pressure increasing means. The interior of each closed container is deoxidized under the reducing action of the reducing gas; then the interior of each closed containers is evacuated and heated up to a temperature equal to or higher than the boiling point of the substance such as metal, galvanizing, oil or the like adhered to the surface of the object to be processed, thereby causing such substance to be evaporated. Subsequently, each closed container is subjected to pressure-reduction while being heated, and the vapor resulting from the above evaporation is recovered which in turn is accommodated recovered and condensed in condensing means provided in a recovery line. As the reducing gas, use is made of hydrogen gas, gas resulting from decomposition of $NH_3$, or the like, and the product is subjected to sufficient deoxidation when the pressure in each closed container is increased and the temperature therein is also elevated or the interior thereof is uniformly heated. It is also possible that such gas may be circulated to the pre-heating chamber and used to reduce the object to be processed.

With reference to the drawings, description will now be made of the apparatus for carrying out the vacuum-evaporation and recovery method according to embodiments of the present invention. The heating furnace body 1 comprises one or more chambers which are partitioned and can be hermetically closed with a sealing door or doors. On the bottom of each chamber, there are provided self-running rollers for transporting trays 60 on which objects to be processed are placed, and an pneumatic or hydraulic device for actuating a pusher. Shafts for the self-running rollers extend out of the hermetically closed chambers and are coupled to a self-running roller driving device. Each chamber consists of a hollow retort covered with a heat insulating material.

The most upstream chamber (left-hand side as viewed in the drawing) constitutes a front evacuation/substitution chamber 3 which is provided with a sealing door 4 at one side and a sealing door 5 at the rear side (at the next adjacent chamber side). The term "evacuation/-substitution" is used herein to mean both the case where the atmosphere in the chamber is evacuated to be a vacuum and the case where the atmosphere in the chamber is substituted with inert gas such as nitrogen gas or the like. There are also provided a door cylinder 6 for opening and closing the door 4; and a door cylinder 7 for opening and closing the door 5.

Figure 4:
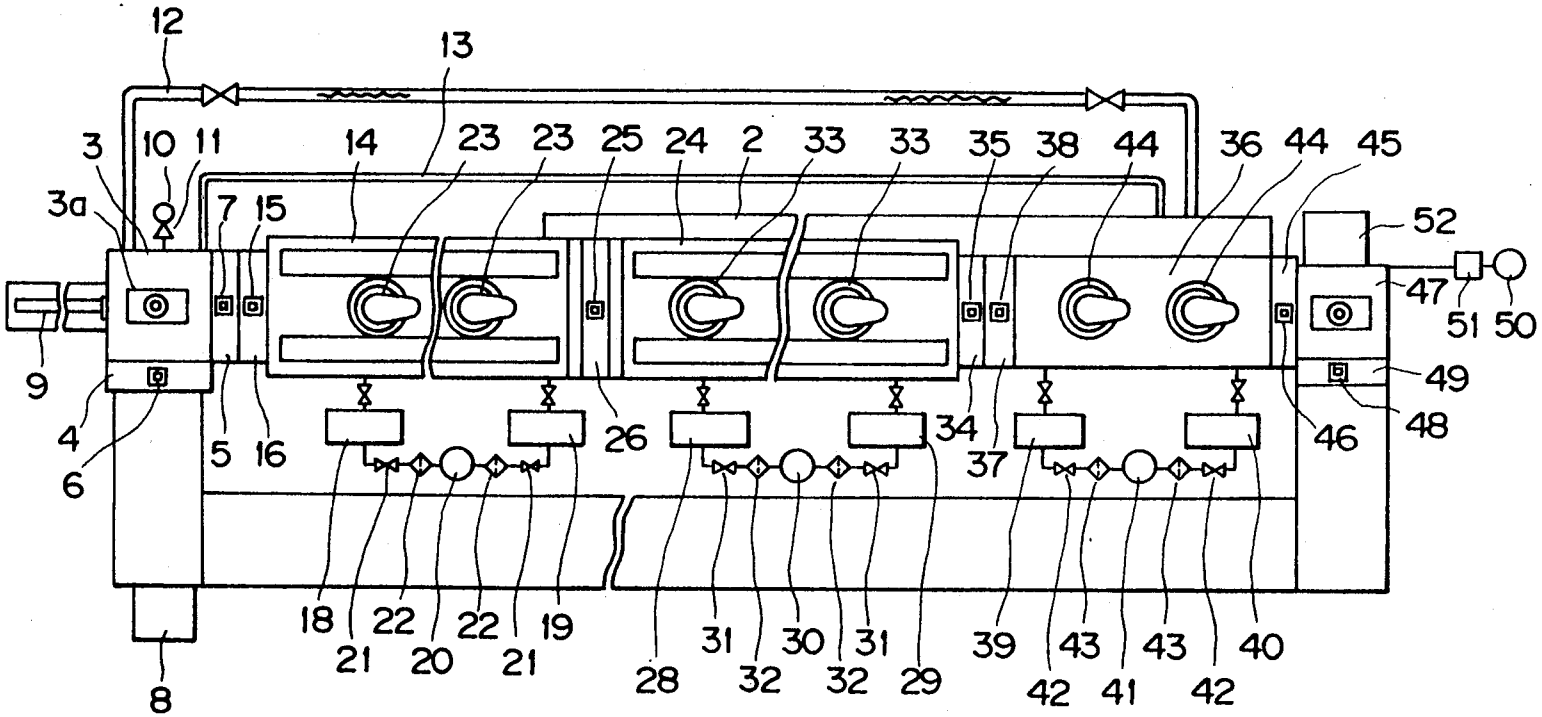
FIG. 4 is a plan view of the apparatus shown in FIG. 3.

As shown in FIG. 4, there is provided a driving device 8 for carrying the trays 60 containing the objects to be processed into the front evaporation/substitution chamber 3. A cylinder 9 acts to push and deliver the objects processed in the front evaporation/substitution chamber 3 into the next adjacent chamber. The front evaporation/substitution chamber 3 is also provided with an agitator 3*a*, a vacuum pump 10 for evacuating the chamber, and condensing means 11 for recovering metal, water and/or oil removed from the object to be processed. A gas circulating pipe 12 for supplying preheating gas, and a recovery pipe 13 for recovering the gas are coupled to the front evaporation/substitution chamber 3.

A first vacuum-heating chamber 14 is provided in contiguous relationship and in communication with the front evaporation/substitution chamber 3. The chamber 4 is provided at the input side with a sealing door 16 which can be opened and closed by a door cylinder 15. The first vacuum-heating chamber 14 is also provided with a heater 717 for heating the interior thereof; condensing means 18 and 19 provided in communication therewith for condensing evaporated substance or the like removed from the object to be processed; and a vacuum pump 20 acting as pressure reducing means for reducing the pressure in the chamber 14. An exhaust pipe is connected to the vacuum pump 20. The first vacuum-heating chamber 14 may also be provided with one or more agitator fans 23 if necessary.

A second vacuum-heating chamber 24 may have the same construction as the first vacuum-heating chamber 14. More specifically, this chamber 24 is provided with a door cylinder 25 for opening and closing a sealing door 26; a heater 27; and condensing means 28 and 29. There are also provided a vacuum pump 30, a vacuum valve 31, a filter 32, and an agitator fan 33. The second vacuum-heating chamber 24 is also provided with a sealing door 34 at the rear side thereof, which is driven to be opened and closed by means of a door cylinder 35.

A third vacuum-heating chamber 36 is provided with a sealing door 37; a door cylinder 38 for opening and closing the sealing door 37; condensing means 39 and 40; a vacuum pump 41; a vacuum valve 42; a filter 43; and a cooling fan 44. The third chamber 36 is also provided at the rear side thereof with a sealing door 45, and a door cylinder 46.

The third heating chamber 36 is followed by a rear evaporation/substitution chamber 47. The chamber 47 is provided with a sealing door 49 which is opened and closed by means of a door cylinder 48; a vacuum pump 50 for evacuating the interior thereof; condensing means 51; and drive means 52 (air cylinder) for taking our the trays 60 transported into the chamber 47. Although not shown in the drawings, in addition to the elements mentioned above, a gas cylinder containing nitrogen, hydrogen or the like is also provided which is connected to the respective vacuum-heating chambers 14, 24, and 36 through piping including a vacuum valve and pressure gauge With the above-mentioned arrangement, when the object to be processed which is placed on the tray 60, is cooled by nitrogen gas and carried into the front evaporation/substitution chamber 3 under the action of the drive means 8, the sealing door 4 is closed under the action of the door cylinder 6. In this case, the sealing door 5 is closed, and thus the chamber 3 is hermetically closed. Then, the vacuum pump 10 is actuated so that the chamber 3 is evacuated, and the object to be processed is subjected to evaporation/substitution and preheated by the nitrogen gas supplied through the gas circulating pipe 12 and heated in the rear evaporation/substitution chamber 47 or alternatively by heating means. Alternatively, the object to be processed may be subjected to evaporation/substitution without being pre-heated.

Subsequently, the sealing door 5 is opened under the action of the door cylinder 7, and the sealing door 16 is also opened under the action of the door cylinder 15. The tray 60 is pushed under the action of the cylinder 9, and carried into the first vacuum-heating chamber 14 by means of the self-running rollers. Then, the sealing door 16 is closed, and thereupon the vacuum pump 20 is actuated so that the chamber 14 is evacuated, and the interior of the chamber 14 is heated by the heater 17. In this way, water, plated metal, oil or the like is evaporated and removed from the object to be processed which is placed on the tray 60, depending on the temperature in the chamber. The substance thus evaporated and removed is fed and condensed in the condensing means 18 and 19. In the case where there is water and/or oil, the heating in the chamber is effected at a relatively low temperature so that primarily liquid substance such as water, oil or the like is removed and recovered.

Thereafter, the sealing door 26 is opened; the object to be processed is transferred to the second vacuum-heating chamber 24; then the sealing door 26 is closed; thereafter, pressure reduction, heating and condensation of evaporated substance are effected as in the first vacuum-heating chamber 14. The heating in the second vacuum-heating chamber 24 is effected at a higher temperature than that in the first vacuum-heating chamber 14 so that primarily solid substancesuch as zincing is vacuum-evaporated.

Further, the object to be processed is transferred to the third vacuum-heating chamber 36 and subjected there to heating at a higher temperature so that zincing or the like is removed therefrom. Subsequently, the object to be processed is carried into the rear evaporation/substitution chamber 47, and when it is desired that the substance removed from the object be recovered in a non-oxidized form, the pressure in the chamber 47 is increased with nitrogen gas, and the substance is taken out after being cooled with the nitrogen gas. The nitrogen gas thus heated is introduced to the respective vacuum-heating chambers through the gas circulating pipe 12. Both the front evaporation/substitution chamber 8 and the rear evaporation/substitution chamber 47 serve to prevent air from flowing into the respective vacuum-heating chambers, thus preventing the recovered substance from being oxidized.

Figure 5:
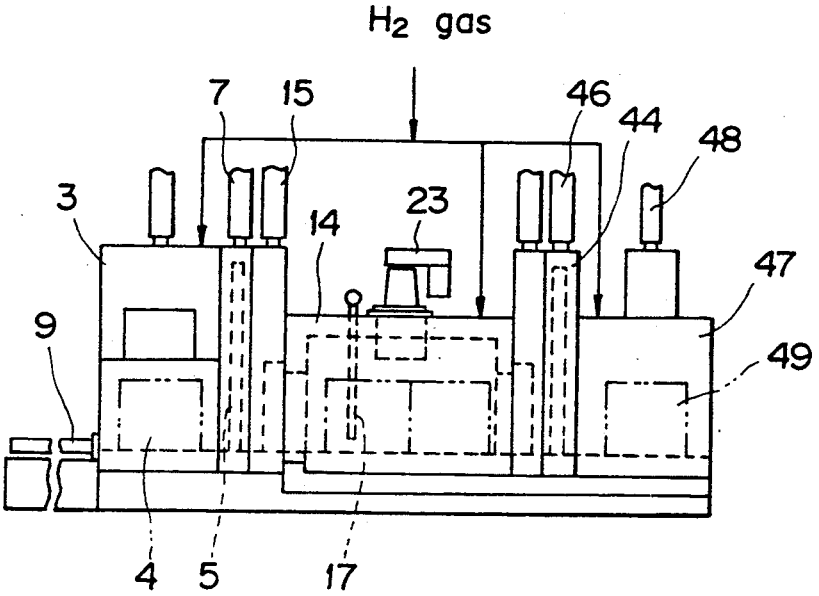
FIG. 5 is a front view showing a third embodiment of the present invention.
Figure 6:
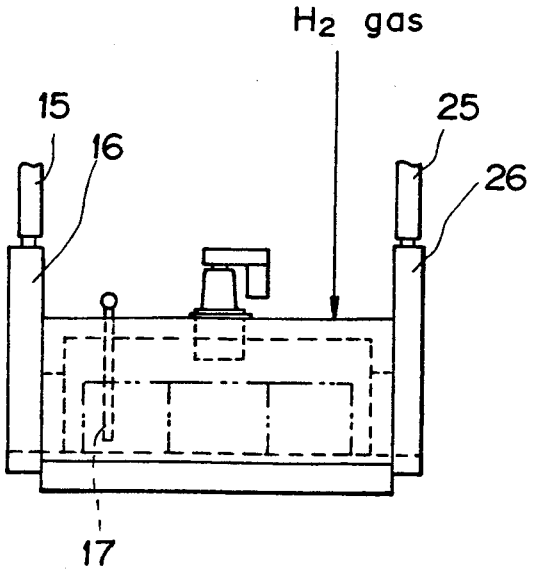
FIG. 6 is a front view showing a fourth embodiment of the present invention.

As shown in FIG. 5, depending on the conditions for recovery, the vacuum-recovering apparatus may be constructed to comprise three chambers, i.e., a front and a rear evaporation/substitution chamber and an intermediate vacuum-evaporation chamber. It may also be constructed to comprise a single chamber without any evaporation/substitution chamber, as shown in FIG. 6. Effectiveness of such constructions has also been experimentally confirmed.

Figure 7:
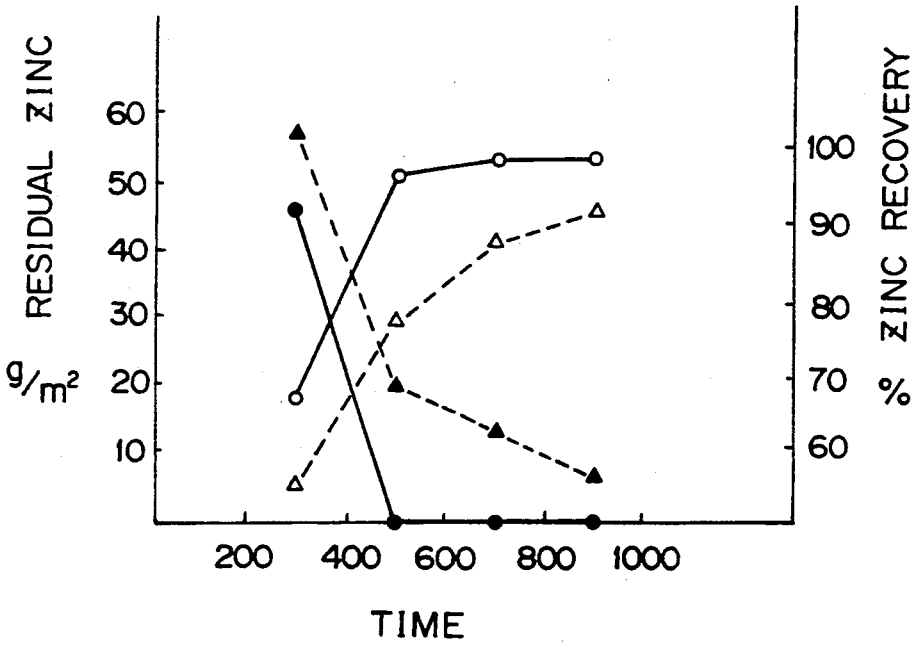
FIG. 7 is a graph illustrating the zinc recovery and the quantity of residual zincing.

The graph of FIG. 7 illustrates the relationship with temperature between the zinc recovery and the quantity of residual zincing which has been obtained as a result of zinc removing test according to the method of the present invention. The test was conducted under the following conditions:

Object to be processed: 300 Kg per piece (shredded article)

Temperature: 300° C., 500° C., 700° C., 900° C.

Vacuum: 5 to $6\times10^{-3}$ Torr

Time: Reduced for 60 minutes; Vacuum-evaporated and recovered for 600 minutes (Oxidation and temperature increase effected for 2 hours respectively)

In FIG. 7, circles indicate the recovery of zincing for the case where the object to be processed was subjected to oxidation and temperature elevation and then to reduction with hydrogen gas and zincing was vacuum-evaporated and recovered therefrom; triangles indicate the recovery of zincing for the case where the object to be processed was subjected to oxidation and temperature elevation and then the zincing was vacuum-evaporated and recovered therefrom; solid circles indicate the quantity of residual zincing for the case where the object to be processed was subjected to oxidation and temperature elevation and then reduction with hydrogen gas and the zincing was vacuum-evaporated and recovered therefrom; and solid triangles indicate the quantity of residual zincing for the case where the object to be processed was subjected to oxidation and temperature elevation and the zincing was vacuum-evaporated and recovered therefrom.

As will be appreciated from what has been described with reference to FIGS. 3 to 7, according to the present invention, metal oxide is removed from the object to be processed by subjecting the latter to oxidation and temperature elevation and then to reduction with hydrogen; thereafter, the atmosphere in which the object to be processed is placed is evacuated, and substance such as zincing, oil, metal or the like adhered to the surface of the object to be processed is vacuum-evaporated to be removed and recovered from the object to be processed. Thus, according to the present invention, the recovery of the substance can be remarkably increased and the substance can be completely removed at a lower temperature as compared with the conventional method which comprises effecting oxidation and temperature elevation and then vacuum-evaporation and recovery. Furthermore, the cleaning and processing procedures are performed in a hermetically closed atmosphere or space so that there occurs no possibility of environmental pollution or the like, and the running cost can be reduced, automation can readily be achieved, and the substance adhered to the surface of the object to be processed can be recovered in a substantially pure form since it is evaporated in a vacuum, so that the substance thus recovered can be recycled.

While the present invention has been illustrated and described with respect to some specific embodiments thereof, it is to be understood that the present invention is by no means limited thereto but encompasses all changes and modifications which will become possible within the scope of the appended claims.

I claim:

1. A method of cleaning a substance from a surface of a solid object to be processed and recovering the substance, which comprises the steps of placing the object to be processed in a closed atmosphere, and heating and evacuating the closed atmosphere to increase temperature therein after reducing pressure in the closed atmosphere, thereby evaporating and then recovering the substance comprising at least one member selected from the group consisting of liquid and solid adhered to the object to be processed, through variations in the temperature and pressure in the closed atmosphere.

2. An apparatus for cleaning the surface of a solid object to be processed, which comprises a closed container having a closed atmosphere in which the object to be processed is placed; heating means for elevating the temperature within the closed container; condensing means in communication with the closed container for condensing metal of non-metal removed from the object to be processed; pressure reducing means for reducing the pressure in the closed container through the condensing means; pressure increasing means for increasing the pressure in the closed container with a non-oxidizing gas; and pre-heating means for utilizing the gas for the purpose of pre-heating the object to be processed.

3. A method of recovering substance adhered to the surface of an object to be processed, by causing such substance to be evaporated in a vacuum, which comprises placing an object to the processed in a furnace provided with heating means; elevating the temperature within the furnace up to a predetermined level with the aid of an oxidizing gas atmosphere; reducing the pressure in the furnace so that the quantity of the oxidizing gas is reduced to be below the explosion limit; feeding a reducing gas atmosphere into the furnace to reduce the oxidization of the object to be processed; thereafter evacuating the interior of the furnace while the interior of the furnace is maintained under a predetermined evaporation temperature condition; and introducing the substance evaporated from the object processed to recovery means provided in contiguous relationship with and in communication with the furnace, so that the evaporated substance is condensed in the recovery means and recovered therefrom.

4. A method of recovering substance adhered to the surface of an object to be processed, by causing such substance to be evaporated in a vacuum, wherein the temperature in a furnace in which the object to be processed is placed, is increased by a method selected from the group consisting of under a vacuum condition and with a reducing gas; the furnace is evacuated when the temperature of the object to be processed reaches a predetermined value; substance evaporated in the vacuum from said object is introduced into recovery means provided in contiguous relationship with and in communication with said furnace; and said substance is condensed in said recovery means and recovered therefrom.

5. An apparatus for recovering substance such as zincing or the like adhered to the surface of an object to be processed, by causing such substance to be evaporated in a vacuum, comprising a closed chamber provided with means for elevating the temperature in a furnace; condensing means for causing gas and liquid to be condensed; pressure reducing means for reducing the pressure in said furnace through said condensing means; and means for increasing the pressure in said furnace with reducing gas.

6. An apparatus according to claim 5, wherein a plurality of said closed chambers are arranged in contiguous relationship with and in communication with each other; and sealing doors attached to each of said closed chambers are opened and closed so that said object to be processed is permitted to be transferred from one closed chamber to another.

7. An apparatus according to claim 6, the heating means, condensing means, pressure reducing means and pressure increasing means associated with each said closed chamber are arranged to be controlled independently.

8. An apparatus according to claim 5, wherein a plurality of said closed chambers are arranged in contiguous relationship with and in communication with each other; and evaporation/substitution chambers are provided at input and output sides of the arrangement of said closed chambers.

9. An apparatus according to claim 6, wherein evaporation/substitution chambers are provided at input and output sides of the arrangement of said closed chambers.

10. A method according to claim 1 further comprising increasing the pressure of the closed atmosphere to a selected pressure before the pressure reduction with a convective and temperature increasing gas prior to heating said closed atmosphere.

* * * * *